US007337558B2

(12) United States Patent
Terlizzi et al.

(10) Patent No.: US 7,337,558 B2
(45) Date of Patent: Mar. 4, 2008

(54) SPLIT SOLE DANCE SHOE HAVING ENHANCED FLEXIBILITY AND SUPPORT

(75) Inventors: Dan Terlizzi, Totowa, NJ (US); Paul Terlizzi, Totowa, NJ (US)

(73) Assignee: Ballet Makers, Inc., Totowa, NJ (US)

( * ) Notice: Subject to any disclaimer, the term of this patent is extended or adjusted under 35 U.S.C. 154(b) by 296 days.

(21) Appl. No.: 11/228,179

(22) Filed: Sep. 16, 2005

(65) Prior Publication Data

US 2006/0196079 A1 Sep. 7, 2006

Related U.S. Application Data

(60) Provisional application No. 60/657,467, filed on Mar. 1, 2005.

(51) Int. Cl.
*A43B 7/18* (2006.01)
*A43B 5/12* (2006.01)

(52) U.S. Cl. ..... 36/8.3; 36/102; 36/91; 36/31

(58) Field of Classification Search ..... 36/88, 36/91, 102, 103, 31, 8.3
See application file for complete search history.

(56) References Cited

U.S. PATENT DOCUMENTS 2,210,304 A 8/1940 Poole
2,237,652 A 4/1941 Capezio
2,332,252 A 10/1943 Payne
3,323,232 A * 6/1967 Danowsky ..... 36/91
4,069,515 A 1/1978 Swallow et al.
4,277,897 A 7/1981 O'Connell
4,408,402 A 10/1983 Looney
4,519,148 A 5/1985 Sisco
4,541,186 A 9/1985 Mulvihill
4,542,598 A 9/1985 Misevich et al.
4,554,749 A 11/1985 Ostrander
4,651,354 A 3/1987 Petrey
4,794,706 A * 1/1989 Puckhaber et al. ..... 36/91
4,944,099 A * 7/1990 Davis ..... 36/97
5,554,107 A 9/1996 Shannahan
5,682,685 A 11/1997 Terlizzi
5,737,776 A 4/1998 Jennings
5,865,779 A 2/1999 Gleason (Continued)

*Primary Examiner*—Marie Patterson
(74) *Attorney, Agent, or Firm*—Lerner, David, Littenberg, Krumholz & Mentlik, LLP

(57) ABSTRACT

A shoe includes a shoe upper made of flexible material, the shoe upper including a toe region, a heel region, a foot opening at the heel region, and an arch region extending between the toe region and the heel region. A split sole is secured to a bottom of the shoe upper, the split sole including a front sole under the toe region of the shoe upper and a rear sole under the heel region of the shoe upper, the front and rear soles being spaced from one another for defining a gap between the front and rear soles that extends along the bottom of the shoe upper. The dance shoe also includes an elastic material attached to the bottom of the shoe upper and covering the gap between the front and rear soles, whereby the elastic material covers an underside of the dance shoe, and at least one support band attached to the shoe upper and being connected with the elastic material for supporting the elastic material and for minimizing wrinkling, puckering, pinching and sagging of the elastic material in the arch region of the shoe upper.

17 Claims, 4 Drawing Sheets

U.S. PATENT DOCUMENTS

| | | | | |
|---|---|---|---|---|
| 6,076,284 | A | 6/2000 | Terlizzi | |
| 6,233,846 | B1 * | 5/2001 | Sordi | 36/28 |
| 6,385,779 | B2 | 5/2002 | Boersema | |
| 6,588,124 | B2 | 7/2003 | Morrone | |
| 6,634,121 | B2 * | 10/2003 | Sordi | 36/102 |
| 6,772,541 | B1 * | 8/2004 | Ritter et al. | 36/88 |
| 6,810,603 | B1 | 11/2004 | Cosentino | |
| 6,857,203 | B2 * | 2/2005 | Minden | 36/8.3 |
| 6,895,693 | B2 * | 5/2005 | Baruck | 36/8.3 |
| 2001/0005947 | A1 * | 7/2001 | Sordi | 36/102 |
| 2002/0017036 | A1 * | 2/2002 | Berger et al. | 36/3 B |
| 2002/0078591 | A1 * | 6/2002 | Morrone | 36/8.3 |
| 2003/0029055 | A1 * | 2/2003 | Morrone | 36/8.3 |
| 2003/0070319 | A1 * | 4/2003 | Minden | 36/8.3 |
| 2004/0159018 | A1 | 8/2004 | Meibock | |
| 2004/0172852 | A1 | 9/2004 | Jones et al. | |

* cited by examiner

100

SPLIT SOLE DANCE SHOE HAVING ENHANCED FLEXIBILITY AND SUPPORT

CROSS REFERENCE TO RELATED APPLICATION

The present application claims benefit of U.S. Provisional Application No. 60/657,467, filed Mar. 1, 2005, the disclosure of which is hereby incorporated by reference herein.

BACKGROUND OF THE INVENTION

The present invention relates to shoes and more particularly relates to dance, exercise, gymnastic, martial arts and yoga shoes that provide foot support without impeding natural foot movement.

In recorded history, every culture has had some form of dance. Some forms of dancing exhibit simple movements, while other dance forms, such as ballet, have very complex movements. Regardless of the type of dance, all forms of dancing require the dancer to use his or her feet. Standard foot movements include stomping, flexing, pointing, jumping, turning, sliding, articulating, and leaping. These movements are executed on a wide variety of substrates such as tile, wood floors, carpet, marley and mats. In many instances, the dance substrates have imperfect or uneven top surfaces, which may be caused by moisture, dirt, splinters, oil, dust, powder, adhesive, etc. The imperfect top surfaces may cause discomfort or injuries to feet.

A typical shoe has a continuous sole that extends from the toe region to the heel region of the shoe. In order to enhance flexibility, many shoes now have a split sole that splits the outsole of the shoe between a front portion beneath the toes of the foot and a rear portion beneath the heel of the foot. These split sole designs have no sole below the arch region of the shoe, which generally improves the overall flexibility of the shoe, and particularly the mid-section or arch region of the shoe. Examples of shoes having split sole designs include U.S. Pat. Nos. 4,519,148 and 4,554,749, which disclose dance shoes having a split sole design, and U.S. Pat. Nos. 4,541,186 and 4,542,598, which disclose athletic shoes having a split sole design.

Commonly assigned U.S. Pat. No. 5,682,685, the disclosure of which is hereby incorporated by reference herein, teaches a dance shoe or slipper having a split front and rear soles separated at the arch. To enable a dancer to stand on pointe, the front sole is "cup" shaped with a generally "C" shaped cross-section. The upstanding wall of the front sole is attached to the sides and may extend up the front of the shoe box, which enables the front sole to bend upwardly about an axis across the foot when the foot bends but prevents the front sole from bending downwardly about the axis.

A shoe upper is typically made of leather, stretchable leather, fabric, or other flexible materials that enable the shoe to flex as the foot moves. The shoe upper may also be made of an elastic or stretchable material. In conventional split sole designs, the flexible, elastic or stretchable nature of the shoe upper typically results in gapping of the material in the arch region or mid-section of the shoe. The existence of gapping, which results in the formation of a space between the arch of the foot and the mid-section material overlying the arch of the foot, is undesirable for a number of reasons. First, the existence of gapping is undesirable because the mid-section of the shoe is not supporting the dancer's arch. Second, the existence of gapping results in the mid-section of the shoe not conforming to the contour of the dancer's arch, which diminishes the aesthetic appearance of the foot.

The have been a few efforts seeking to avoid sagging of the mid-section of split sole shoes. For example, commonly assigned U.S. Pat. No. 6,076,284, the disclosure of which is hereby incorporated by reference herein, teaches a dance shoe having a split sole, with a front sole portion supporting the front of the foot, a rear sole portion beneath the rear of the foot and no sole beneath the mid-section of the shoe, i.e. beneath the arch of the foot. To help support the foot and prevent sagging of the mid-section of the shoe upper, a band of flexible, but non-stretchable, fabric is stitched inside the shoe upper. The flexible fabric extends from the bottom of the shoe upper, over the sides of the shoe upper, and to the top of the shoe upper. The stitched-in fabric material supports the mid-section of the shoe, minimizes sagging, and permits unhindered flexing and bending of the foot. When the shoe is closed or laced, the closing of the top of the shoe upper pulls up on the band.

U.S. Pat. No. 6,588,124 and U.S. Patent Appln. No. 2003/0029055 teach a dance shoe having a diamond shaped "gusset" region that covers the arch of the foot. While the split sole shoes disclosed in the above-identified patent references have been shown to provide enhanced flexibility in the arch region of the foot, these split sole designs provide inadequate arch support. In addition, the material in the arch regions tends to bunch up below the arch when pointing, making the wearer both uncomfortable and very aware of the shoe being worn on the foot. Bunching also diminishes the aesthetic appearance of the shoe, which may reduce the confidence of the wearer.

In view of the above, there remains a need for a dance shoe that provides minimal resistance for at least six foot movements including flexing, pointing, resting, toeing, articulating, turning and spinning. The at least six foot movements may be referred to as "six degrees of freedom." There is also a need for a dance shoe that provides adequate support as the foot moves through the at least six foot movements discussed above. In addition, there is a need for a split sole dance shoe that provides adequate support for the mid-section of the shoe. There is also a need for a dance shoe that minimizes gapping, bunching, buckling, pinching and puckering of the material that covers the arch region of the foot.

SUMMARY OF THE INVENTION

It is an object of the present invention to provide a dance shoe that provides proper support for a foot while the foot is in motion, but which allows unhindered foot movement without gapping, buckling, pinching, bunching or puckering of the shoe material.

It is another object of the present invention to improve the comfort of dance shoes.

It is a further object of the present invention to improve the aesthetic appearance of dance shoes by providing shoes that readily conform to the contour of a foot as the foot moves through various positions.

It is yet another object of the present invention to provide a dance shoe having a split sole, namely a front sole, a rear sole, and an arch or mid-section for enabling flexibility of the foot.

According to the present invention, the shoe is structured from flexible materials using designs that avoid discomfort while increasing flexibility. The combination of materials and the design of the shoe preferably provides support to the foot and increases flexibility around the axis of the arch in at least six directions, providing added flexibility. The shoe may be in the form of a dance shoe, a dance sandal, a dance sneaker, a dance slipper, a gymnastic shoe, an exercise shoe, an athletic shoe, a sneaker, etc.

In certain preferred embodiments of the present invention, a dance shoe includes a shoe upper made of a flexible material, the shoe upper including a toe region, a heel region, a foot opening at the heel region, and an arch region extending between the toe region and the heel region. The shoe upper may be made of any flexible, durable material such as leather, suede, nylon, cotton, lycra or spandex.

The dance shoe also desirably includes a split sole secured to a bottom of the shoe upper, the split sole including a front sole under the toe region of the shoe upper and a rear sole under the heel region of the shoe upper. The front and rear soles are desirably spaced from one another for defining a gap between the front and rear soles that extends along the bottom of the shoe upper. The first and second soles may be made of materials such as leather, suede, rubber, lightweight low-density foam material such as EVA polyethylene blend, rubber, a viso-elastic polymer such as SORBOTHANE and other shock-absorbing materials. The materials may be combined together to form the first and second soles. In certain preferred embodiments, one of the soles may be made of a first material and a second one of the soles may be made of a second material.

The dance shoe of the present invention also preferably includes an elastic material attached to the bottom of the shoe upper. The elastic material desirably covers the gap between the front and rear soles, i.e. an underside of the dance shoe. The dance shoe may also include at least one support band attached to the shoe upper and connected with the elastic material. The at least one support band desirably supports the elastic material and minimizes sagging of the elastic material in the arch region of the shoe upper. The at least one support band is preferably flexible and/or elastic. The elastic material desirably covers the underside of the dance shoe and has more elasticity than the at least one support band.

In certain preferred embodiments, the at least one support band includes a pair of laterally extending support bands having first ends adjacent the toe region of the shoe upper and second ends adjacent the heel region of the shoe upper. The laterally extending support bands may be attached to the shoe upper and the elastic material covering the underside of the dance shoe for supporting the elastic material. The shoe may also include supplemental support bands having lower ends attached to the elastic material and upper ends including loops.

In certain preferred embodiments, the at least one support band is attached to the exterior surface of the shoe upper. In other preferred embodiments, however, the at least one support band may be attached to an interior surface of the shoe upper or concealed between the shoe upper and an inner liner.

The dance shoe may also include at least one lace, such as a shoelace, that is threaded through the loops. The lace is preferably adapted to selectively pull the support bands toward the top of the dance shoe, which, in turn, pulls the elastic material toward the top of the dance shoe.

In another preferred embodiment of the present invention, a dance shoe includes a shoe upper including a toe region, a heel region, and an arch region extending between the toe region and the heel region. The shoe also desirably includes a split sole attached to a bottom of the shoe upper, the split sole including a front sole beneath the toe region of the shoe upper and a rear sole beneath the heel region of the shoe upper. The front and rear soles are desirably spaced from one another for defining a gap between the front and rear soles. The gap preferably extends along the bottom of the shoe upper and is in substantial alignment with the arch region of the shoe upper.

The dance shoe may also include an elastic material attached to the bottom of the shoe upper and covering the gap between the front and rear soles, whereby the elastic material covers an underside of the dance shoe. At least one support band is desirably attached to the shoe upper and is connected with the elastic material for supporting the elastic material in the arch region of the shoe upper.

A lace may be coupled with the at least one support band for selectively exerting an upward force on the at least one support band, whereby the at least one support band transfers the upward force to the elastic material for supporting the arch region of the shoe.

In certain preferred embodiments, the at least one support band comprises a pair of laterally extending bands having first ends adjacent the toe region of the shoe upper and second ends adjacent the heel region of the shoe upper. The laterally extending bands desirably cross the arch region of the shoe upper. The shoe may also include supplemental support bands that are attached to the laterally extending support bands, with one or more loops attached to the supplemental support bands. The loops are preferably adapted to receive a lace.

A first one of the supplemental support bands may be attached to one of the laterally extending support bands and a second one of the supplemental support bands is desirably movable relative to the one of the laterally extending support bands.

The dance shoe of the present invention desirably provides increased flexibility in the arch area, without resulting in wrinkling, bunching, gapping, sagging, pinching or puckering of the material beneath the arch. Although the present invention is not limited by any particular theory of operation, it is believed that providing a dance shoe having a split sole will maximize the flexibility of the shoe because the sole will not resist flexing and bending of the shoe and particularly flexing and bending of the mid-section/arch region of the shoe upper. Moreover, providing at least one support band attached to the mid-section/arch region of the shoe upper will minimize gapping and/or sagging of the elastic material underlying the mid-section/arch region of the shoe. As a result, the elastic material will remain against the contour of the arch of the foot, thereby enhancing the aesthetic appearance of the foot. The above is particularly relevant when the foot is in the pointe position.

In other preferred embodiments of the present invention, the material that extends between the front sole and the rear sole and that covers the underside of the dance shoe preferably has more elasticity than the at least one support band. The material covering the gap may include leather and leather with a lycra backing.

These and other preferred embodiments of the present invention will be described in more detail below.

BRIEF DESCRIPTION OF THE DRAWINGS

The above description, as well as further objects, features and advantages of the present invention will be more fully understood with reference to the following description of preferred embodiments considered in conjunction with the accompanying drawings.

DETAILED DESCRIPTION OF PREFERRED EMBODIMENTS

Figure 1A:
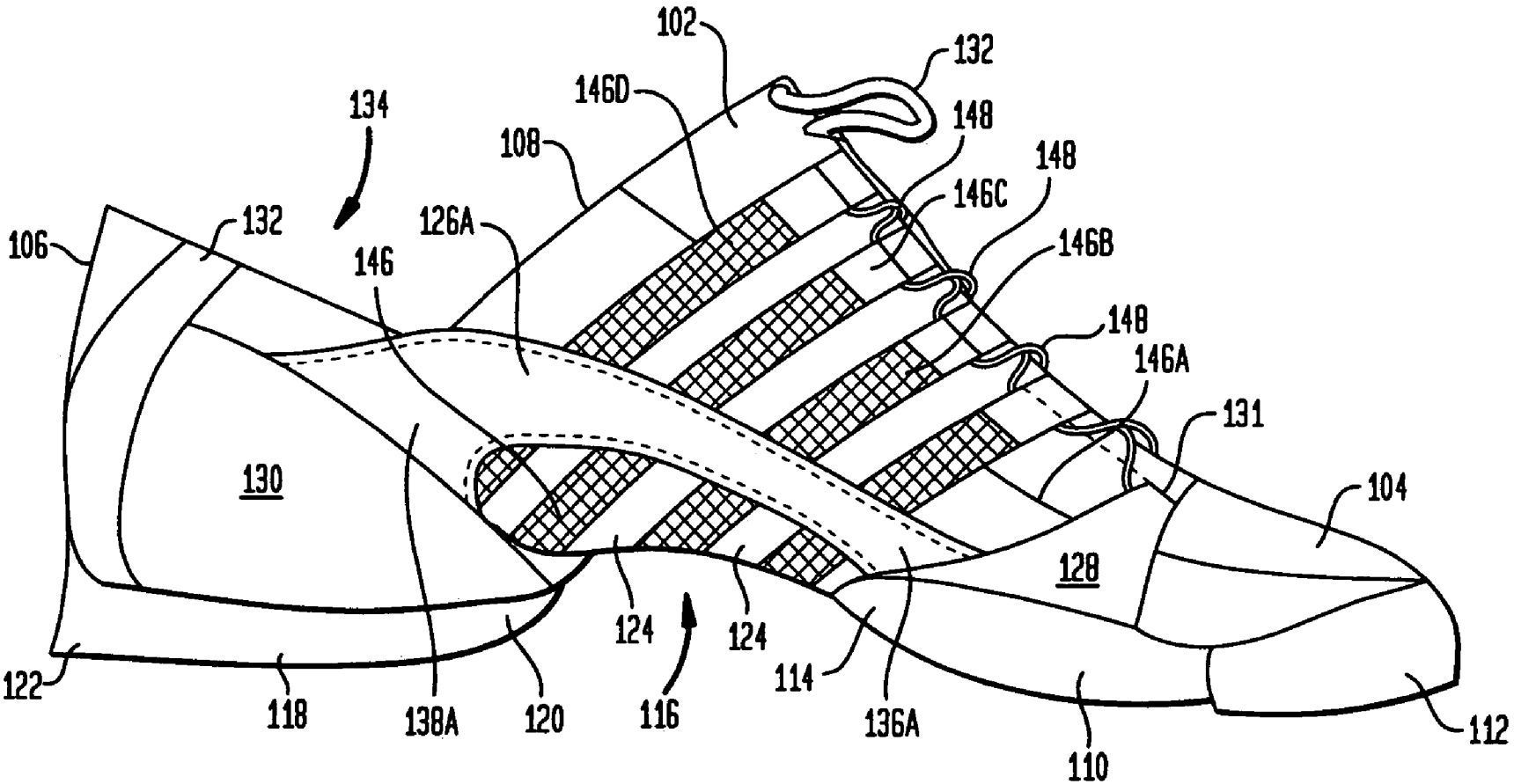
FIG. 1A is a side view of a dance shoe having a split sole, in accordance with one preferred embodiment of the present invention.
Figure 1B:
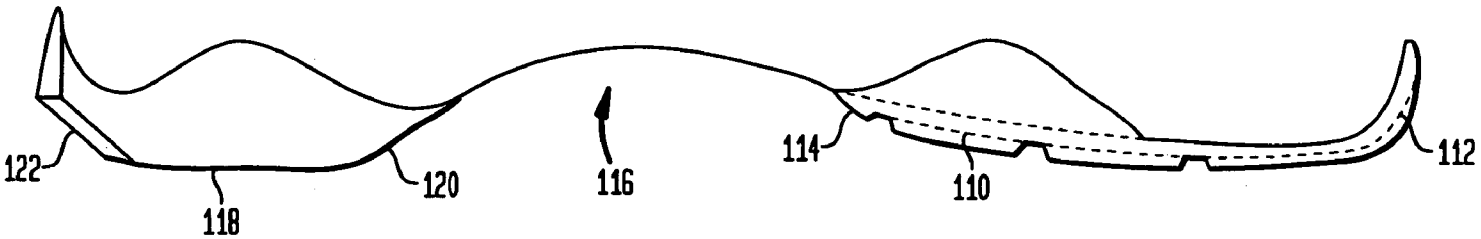
FIG. 1B is a side view of the split sole dance shoe shown in FIG. 1A.
Figure 1C:
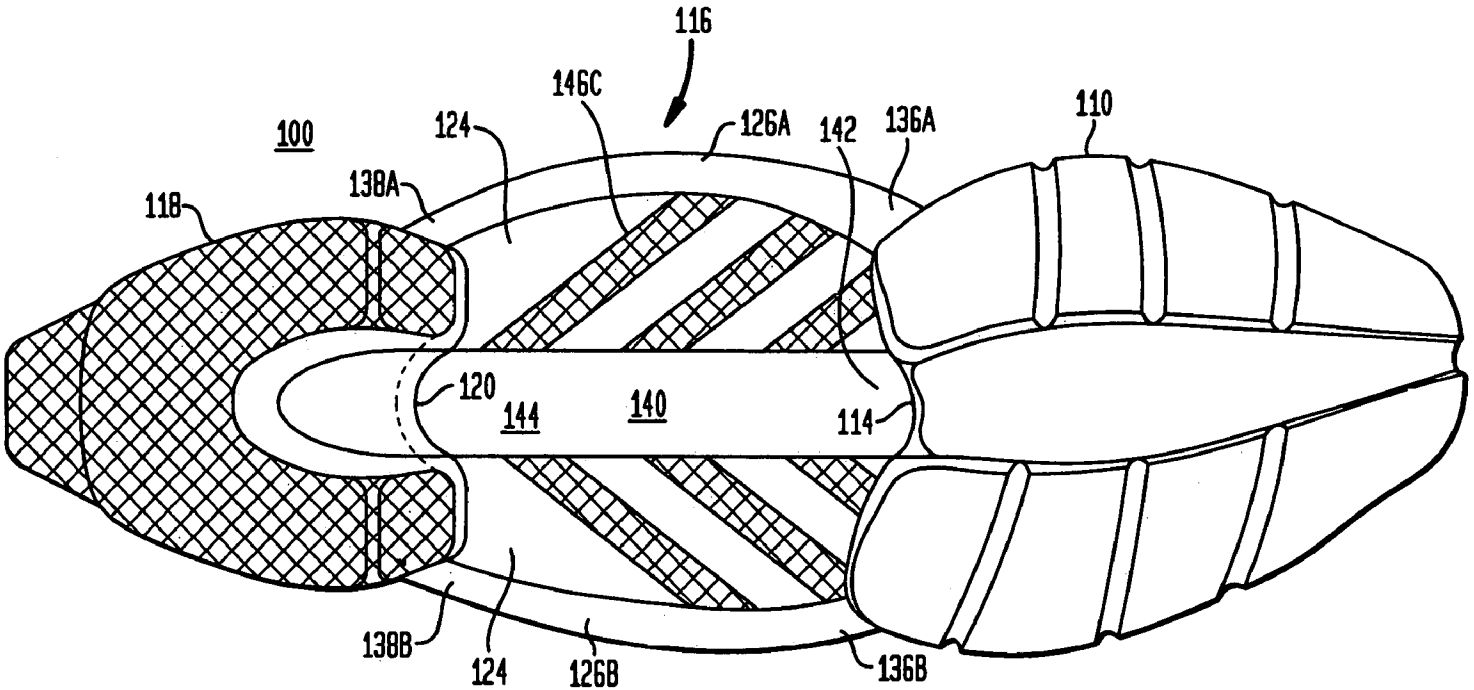
FIG. 1C is a bottom view of the split sole dance shoe shown in FIG. 1A.

FIGS. 1A-1C show a dance shoe, in accordance with certain preferred embodiments of the present invention. The dance shoe 100 includes a shoe upper 102 having a toe region 104, a heel region 106 and a mid-section or arch region 108 that is disposed between the toe region 104 and the heel region 106. The shoe upper may be made from of a variety of flexible materials that enable the shoe to flex and bend when worn by a user. Preferred flexible materials for making the shoe upper 102 include leather, suede, elastic materials, nylon, cotton, lycra and spandex.

The sole of the dance shoe 100 is preferably a split sole including a front sole 110 that underlies the toe region 104 of the shoe upper 102. The front sole 110 has a leading end 112 that defines a toe of the shoe 100 and a trailing end 114 that terminates adjacent the arch region 116 of the shoe 100. The split sole dance shoe 100 also includes a rear sole 118 that underlies the heel region 106 of the shoe upper 102. The rear sole 118 has a leading end 120 that is adjacent the arch region 116 and a trailing end 122 that defines the rear heel of the shoe.

In the particular preferred embodiment shown in FIG. 1A, the sole does not extend continuously between the toe 112 and the heel 122 of the shoe 100. Specifically, the sole is split in two to provide the front sole 110 underlying the toe region 104 of the shoe and the rear sole 118 underlying the heel region 106 of the shoe. As a result, there is preferably no sole attached to, in communication with, or underlying the mid-section or arch region 116 of the shoe. In other words, the front and rear soles 110, 118 are spaced from one another and define a gap at the bottom of the shoe upper that extends between the front and rear soles. Providing a dance shoe having no sole underneath the arch region enhances the flexibility of the shoe and enables the foot to be placed in a variety of different positions without forcing the dancer to overcome excessive resistance from the shoe.

In the particular preferred embodiment shown in FIG. 1A, the heel region 106 of the shoe upper 102 includes a supportive material 130 that wraps around the heel of the foot to provide extra support. In certain preferred embodiments, the supportive material 130 may include a heel cup that is attached to the shoe upper 102.

As shown in FIGS. 1A and 1C, the dance shoe 100 includes an elastic material 124 that is attached to a bottom of the shoe upper and that covers the gap between the front and rear soles 110, 118. As shown in FIG. 1C, the elastic material 124 covers the bottom of the dance shoe and extends between front sole 110, rear sole 118 and laterally extending support bands 126A, 126B. The elastic material 124 in the arch region 116 is preferably at least as flexible and elastic as the other materials comprising the shoe upper 102. In more preferred embodiments, however, the elastic material 124 in the arch region 116 is more elastic and/or more flexible than the material comprising the shoe upper 102.

Referring to FIGS. 1A and 1C, the dance shoe includes a pair of laterally extending support bands 126A, 126B. The laterally extending support bands 126A, 126B are elongated and generally extend along an axis running between the toe 112 and the heel 122 of the shoe. The support bands 126A, 126B have leading ends 136A, 136B that are attached to a first reinforcing patch 128. In preferred embodiments, the leading ends 136A, 136B are sewn to the first reinforcing patch 128. The laterally extending support bands 126A, 126B also have trailing ends 138A, 138B that are attached to the second reinforcing patch 130. Once again, in highly preferred embodiments, the trailing ends 138A, 138B of the laterally extending support bands 126A, 126B are sewn to the second reinforcing patch 130.

Referring to FIG. 1A, the first patch of reinforcing material 128 may be made of sturdy materials such as suede or leather. The reinforcing patch 128 may have one or more loops 131 adapted to receive shoelaces 132. The dance shoe 100 also preferably includes the supportive material 130, hereinafter referred to as a second reinforcing patch that is sewn onto the exterior surface of the shoe upper in the heel region of the shoe. The second reinforcing patch 130 extends upwardly from the rear sole 118. Shoe 100 also preferably includes a third reinforcing patch 132 that is sewn onto the exterior surface of the shoe upper 102. The third reinforcing patch extends upwardly from the heel 122 toward the shoe opening 134. The second and third reinforcing patches 130, 132 are preferably made of materials that are sturdier than the materials comprising the shoe upper 102. In certain preferred embodiments, the second and third reinforcing patches 130, 132 are made of materials such as leather and suede.

The dance shoe also preferably includes supplemental support bands 146A-146D that work in cooperation with the laterally extending support bands 126A, 126B for lifting the elastic material that covers the arch region of the shoe. In certain preferred embodiments, the supplemental support bands 146A-146D are attached to the laterally extending support bands 126A, 126B. In other preferred embodiments, however, some of the supplemental bands may be attached to the laterally extending support bands and some of the supplemental bands may not be attached to the laterally extending support bands, but may be movable relative thereto. In one highly preferred embodiment, one or more of the supplemental support bands are free to slide relative to the laterally extending bands in channels formed between the supplemental support bands and the shoe upper. The supplemental support bands are preferably attached to the elastic material, such as being stitched to the elastic material. The supplemental support bands 146A-146D are preferably spaced from one another so that the elastic material 124 in the arch region 116 of the shoe 100 extends therebetween.

Referring to FIG. 1A, loops 148 are attached to the upper ends of the supplemental support bands 146A-146D. A shoelace 132 may be passed through the loops 148 and the loop 131 in the first reinforcing patch 128 for tightening the shoe upper around a foot once a foot has been inserted into the shoe. Referring to FIG. 1C, three of the supplemental support bands 146A-146C desirably extend to the bottom of the shoe, in the arch region 116 thereof. The three supplemental support bands 146A-146C are attached to the elastic material 124 covering the underside of the shoe.

The support bands 126A, 126B and 146A-146D support the elastic material 124 in the arch region 116 of the shoe.

In certain preferred embodiments, the laterally extending support bands 126A, 126B support the elastic material 124 indirectly, and the supplemental support bands 146A-146D support the elastic material 124 directly. The laterally extending support bands 126A, 126B are preferably attached to the exterior surface of the shoe upper 102. In other preferred embodiments, however, the supplemental support bands 126A, 126B may be attached to the interior surface of the shoe upper 102, or to both the interior and exterior surfaces.

Referring to FIG. 1C, the shoe 100 preferably includes a strip of material 140 that conceals and finishes one or more seams at an underside of the shoe. The strip of material 140 is preferably made of leather, stretchable leather, leather and lycra, or any flexible, elastic or stretchable material. The strip of material 140 may also be made of a spring-like material that serves to hold up the elastic material 124 covering the arch region of the shoe. The strip of material 140 preferably has a leading end 142 connected with the trailing end 114 of first sole 110 and a second end 144 connected with a leading end 120 of second sole 118.

Upper ends of the supplemental support bands 146A-146D may include loops 148 that are adapted to receive the shoelace 132 passed therethrough. As the shoelace is tied, the supplemental support bands 146A-146D and the laterally extending support bands 126A, 126B are pulled toward the top of the shoe, which in turn pulls on the elastic material 124 covering the arch region 116 of the shoe. Thus, the elastic material 124 is pulled tightly over the arch of the foot so that the elastic material supports the arch of the foot and does not gap or sag away from the foot.

As a result of providing the elastic material 124 in the arch region 116, and because of the split sole design, the structure of the shoe provides little or no resistance as the foot flexes and bends between various foot positions. This particular structure provides a distinct advantage over prior art shoes that have a continuous sole extending between the leading and trailing ends of the shoe.

Although the present invention is not limited by any particular theory of operation, it is understood by those skilled in the art that the material in the arch region of split sole shoes tends to gap or sag as the foot move through various positions. Thus, the present invention avoids this problem by providing support in the arch region 116 of the split sole dance shoe 100, using support bands 126A, 126B, and 146A-146D that are attached to the shoe upper 102. Moreover, by providing one or more support bands that provide direct or indirect support to the elastic material 124 covering the arch of the foot, the one or more support bands pull on the elastic material 124 covering the arch region of the foot, creating a contoured fit of the elastic material against the foot's arch. Thus, the material covering the arch region of the foot will move with the foot's movement, and remain against the arch of the foot, thereby improving the level of support provided to the arch region of the foot and improving the aesthetic appearance of the shoe on the foot. As a result, the elastic material 124 at the underside of the shoe will not bunch up, gap or wrinkle, which further minimizes the amount of resistance that must be overcome as the foot moves between various bending, pointing and flexing positions.

It is believed that the support bands 126A, 126B, and 146A-146D, individually or in combination, provide a level of support to the elastic material 124 in the arch region 116 of the shoe. The spacing of the support bands 126A, 126B, and 146A-146D, enables the elastic material 124 to exhibit sufficient elasticity and flexibility so as to not constrain the foot of a dancer as the foot is moved between various positions. The support bands also hold the elastic material 124 against the arch of the foot to prevent sagging or gapping of the elastic material. Moreover, providing the support bands on the exterior surface of the shoe minimizes any discomfort that could occur if the support bands were provided on the inside of the shoe. In other preferred embodiments, however, the support bands may be provided over an interior surface of the shoe upper or between the shoe upper and a liner (i.e. concealed).

Figure 2A:
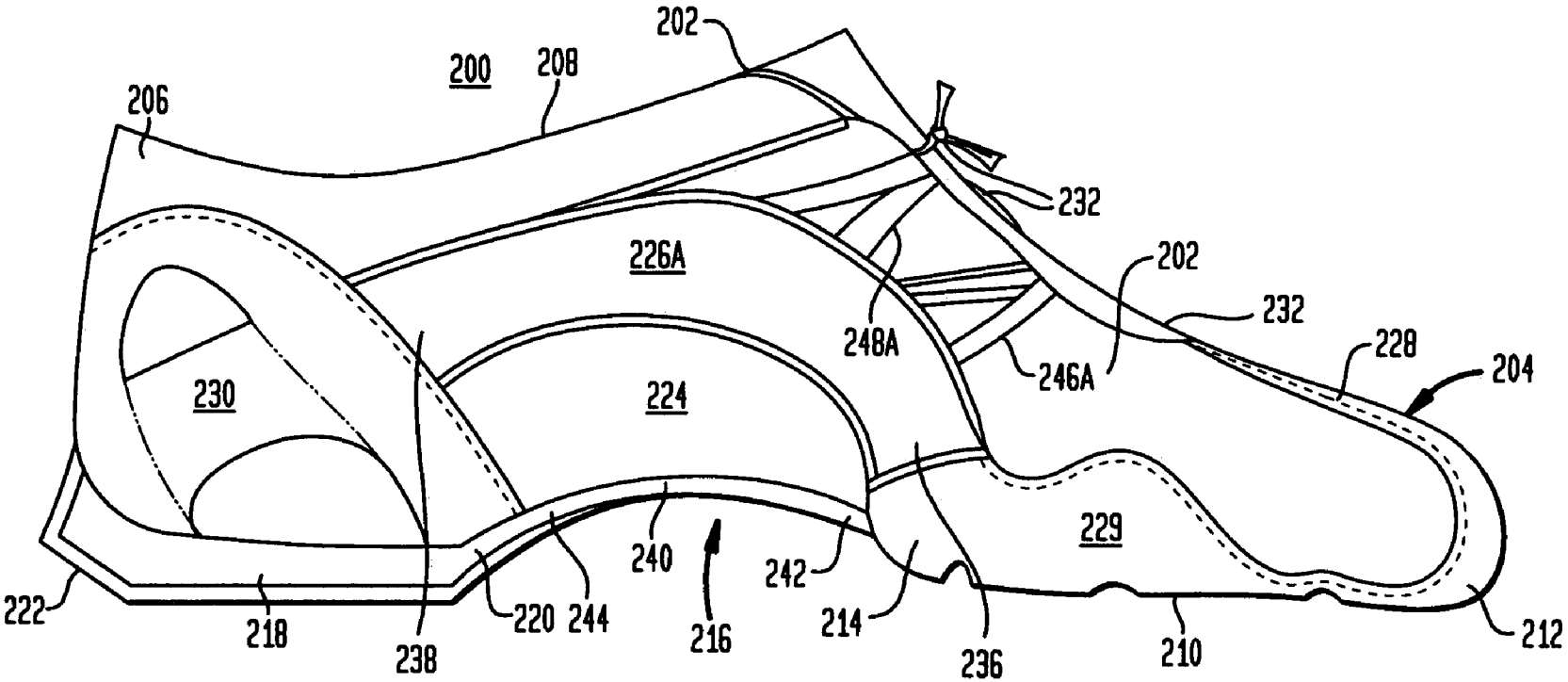
FIG. 2A is a side view a dance shoe, in accordance with another preferred embodiment of the present invention.
Figure 2B:
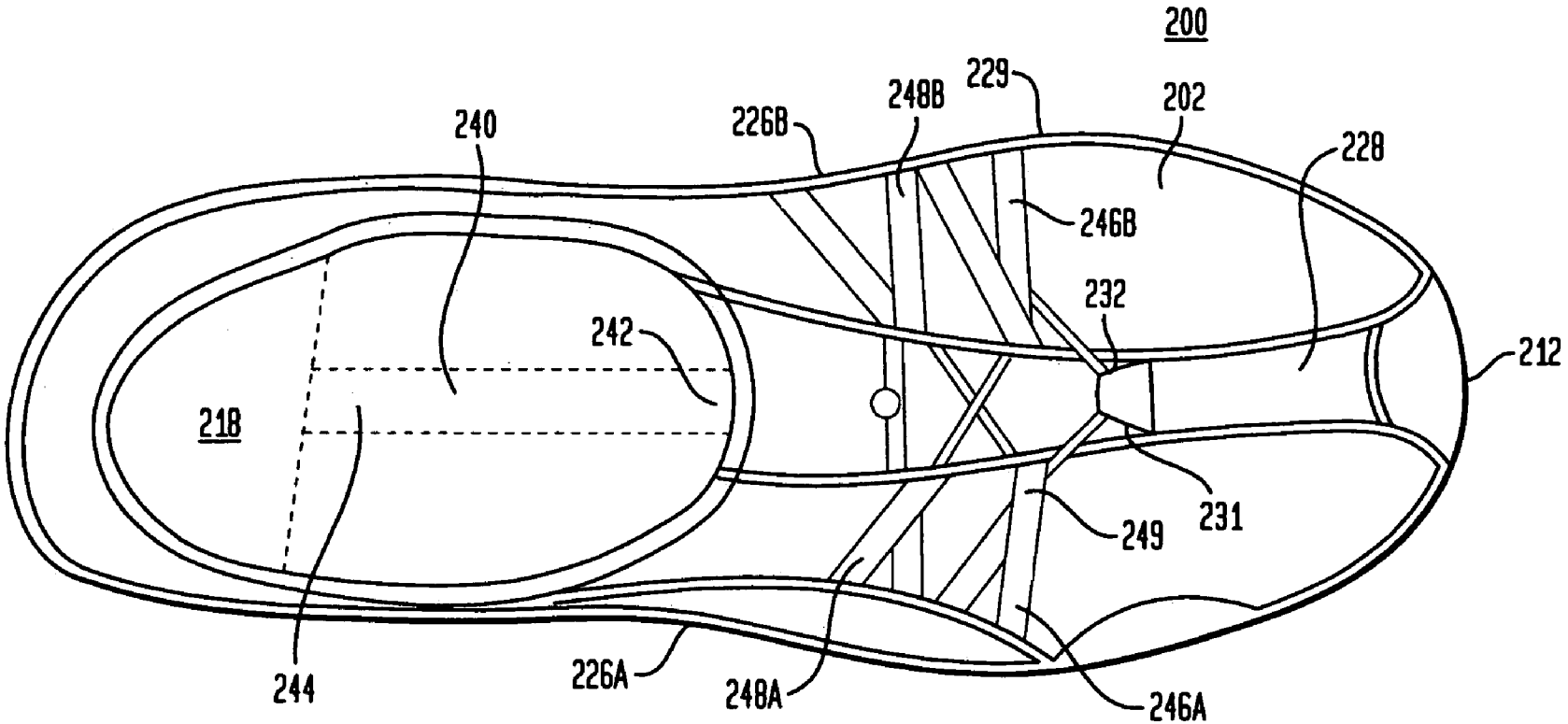
FIG. 2B is top plan view of the dance shoe of FIG. 2A.

FIGS. 2A and 2B show a dance shoe 200, in accordance with another preferred embodiment of the preferred invention. The dance shoe 200 includes a shoe upper 202 made of a flexible material such as leather, stretchable leather, suede, cotton, nylon, fabric, or other flexible materials that enable the shoe to flex and bend as the foot moves. The shoe upper 202 may also be made of an elastic material. The shoe upper 202 includes a toe region 204, a heel region 206 and a mid-section 208 that lies between the toe region 204 and the heel region 208. The dance shoe 200 has a split sole design. Referring to FIG. 2A, the split sole design includes a front sole 210 having a leading end 212 defining a toe and a trailing end 214 that lies adjacent an arch region 216. The shoe 200 also includes a rear sole 218 that supports the heel of the shoe. The rear sole 218 includes a leading end 220 that lies adjacent the arch region 216 of the shoe and a trailing end 222 that defines a heel of the shoe. The split sole may be made of leather, suede, rubber, lightweight low-density foam material such as EVA polyethylene blend, a viso-elastic polymer such as SORBOTHANE or other shock-absorbing materials. In one particular preferred embodiment, the front sole 210 is made of suede and the rear sole 218 is made of a polymer material. Other material combinations for the soles are also preferred.

The dance shoe 200 also preferably includes one or more reinforcing patches made of materials that are sturdier than the shoe upper material. The reinforcing patches reinforce areas of the shoe that undergo high forces and/or stresses. In the particular preferred embodiment shown in FIGS. 2A and 2B, the shoe includes a first reinforcing patch 228 that extends between toe 212 and a loop 231 for shoelace 232. The first reinforcing patch 228 is preferably made of a sturdy material such as leather or suede and may be sewn to the exterior surface of the shoe upper. The dance shoe 200 also preferably includes a second reinforcing patch 229 that overlies the exterior surface of the shoe upper on the sides of the shoe. The second reinforcing patch 229 is preferably attached to the exterior surface of the shoe upper material, such as by stitching or adhesion. The second reinforcing patch 229 is preferably made of a material that is sturdier than the shoe upper material, such as leather or suede.

The dance shoe 200 also preferably includes a third reinforcing patch 230 that covers the heel region 206 of the shoe upper 202. The third reinforcing patch 230 is preferably secured to the exterior surface of the shoe upper. In certain preferred embodiments, the third reinforcing patch 230 comprises material such as leather and suede. The third reinforcing patch 230 is preferably attached to the exterior surface of the shoe upper such as by stitching or adhesion. In other preferred embodiments, the third reinforcing patch 230 may be attached to the interior surface of the shoe upper or concealed between the shoe upper and a liner.

As shown in FIG. 2A, the dance shoe 200 includes an elastic material 224 that is attached to a bottom of the shoe upper and that covers a gap between the front and rear soles 210, 218. The elastic material 224 preferably covers the bottom of the dance shoe 200 and extends between the front sole 210, the rear sole 218 and laterally extending support bands 226A, 226B. The elastic material 224 in the arch region 216 is preferably at least as flexible and elastic as the other materials comprising the shoe upper 202. In more preferred embodiments, however, the elastic material 224 in the arch region 216 is more elastic and/or more flexible than the material comprising the shoe upper 202.

The laterally extending support bands 226A, 226B have first ends 236 that are attached to the first reinforcing patch 229 and second ends 238 that are attached to the third reinforcing patch 230. The laterally extending support bands 226A, 226B also preferably include second ends 238 that are attached to the third reinforcing patch 230. In highly preferred embodiments, the first ends 236 are sewn to the second reinforcing patch 229 and the second ends 238 are sewn to the third reinforcing patch 230.

The laterally extending support bands 226A, 226B are preferably flexible. In certain preferred embodiments, the laterally extending support bands may be made of an at least partially stretchable material that allows the support bands 226A, 226B to move without buckling, gapping, pinching, puckering, and/or wrinkling.

In certain preferred embodiments, in order to conceal seams at an underside of the arch, the shoe includes a strip of material 240 that is secured over the exterior surface of the elastic material 224. The strip of material 240 preferably has a first end 242 that is attached to the trailing end 214 of the first sole 210 and a second end 244 that is attached to the leading end 220 of the second sole 218.

Referring to FIGS. 2A and 2B, the shoe also includes supplemental support bands 246 and 248. The supplemental support bands have upper ends with loops 249 that receive a shoelace 232 and lower ends that are attached to laterally extending support bands 226A, 226B. The supplemental support bands 246, 248 are preferably stitched to the shoe upper 202 and stitched under first support band 226. When the shoelace is tightened, upward forces are transferred through the supplemental support bands 246, 248 to the laterally extending support band 226A, 226B, which in turn transfers upward forces to the elastic material 224 covering the arch region 216 of the shoe 200. Thus, the elastic material 224 in the arch region 216 is pulled toward the top of the shoe and against the arch of the foot for providing lateral and medial support for the foot and providing a glove-like fit that follows the contour of the foot. The upward force exerted upon the elastic material 224 also prevents the elastic material from sagging or forming a gap between the elastic material and the arch of the foot. As described above, such sagging and/or gapping will diminish the aesthetic appearance of the foot and may cause the shoe to generate resistance to various foot movements.

In the present application, certain terminology is used to describe the various embodiments of the present invention. The terminology is used for the sake of clarity, and is not intended to limit the present invention to the specific terms utilized. As such, it is understood that each specific term includes all technical equivalents, which operate in a similar manner to accomplish a similar purpose.

In certain preferred embodiments, the present invention may include one or more embodiments disclosed in commonly assigned U.S. patent application Ser. No. _____, entitled "Protective Foot Covering And Dance Shoes Incorporating Same," filed on even date herewith, which claims the benefit of U.S. Provisional Application Ser. No. 60/657,468, filed Mar. 1, 2005, the disclosures of which are hereby incorporated by reference herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised and employed without departing from the spirit and scope of the present invention as defined by the appended claims.

What is claimed is:

1. A dance shoe comprising:

a shoe upper made of a flexible material, said shoe upper including a toe region, a heel region, a foot opening at the heel region, and an arch region extending between said toe region and said heel region;

a split sole secured to a bottom of said shoe upper, said split sole including a front sole under said toe region of said shoe upper and a rear sole under said heel region of said shoe upper, said front and rear soles being spaced from one another for defining a gap between said front and rear soles that extends along the bottom of said shoe upper;

an elastic material attached to the bottom of said shoe upper and covering the gap between said front and rear soles, wherein said elastic material covers an underside of said dance shoe;

at least one support band attached to said shoe upper and being connected with said elastic material for supporting said elastic material and for minimizing wrinkling, puckering, pinching and sagging of said elastic material in said arch region of said shoe upper.

2. The dance shoe as claimed in claim 1, wherein said at lease one support band is flexible.

3. The dance shoe as claimed in claim 1, wherein said at least one support band is elastic.

4. The dance shoe as claimed in claim 1, wherein said elastic material that covers the underside of said dance shoe has more elasticity than said at least one support band.

5. The dance shoe as claimed in claim 1, wherein said shoe upper comprises a material selected from the group consisting of leather, suede, nylon, cotton, lycra and spandex.

6. The dance shoe as claimed in claim 1, wherein said at least one support band comprises a pair of laterally extending support bands having first ends adjacent said toe region of said shoe upper and second ends adjacent said heel region of said shoe upper.

7. The dance shoe as claimed in claim 6, wherein said laterally extending support bands are attached to said shoe upper and said elastic material covering the underside of said dance shoe for supporting said elastic material.

8. The dance shoe as claimed in claim 7, further comprising supplemental support bands having lower ends attached to said elastic material and upper ends including loops.

9. The dance shoe as claimed in claim 8, further comprising at least one lace that is threaded through said loops, wherein said lace is adapted to selectively pull said support bands toward a top side of said dance shoe which in turn pulls said elastic material toward the top side of said dance shoe.

10. The dance shoe as claimed in claim 1, wherein said first and second soles comprise materials selected from the group consisting of leather, suede, rubber, lightweight low-density foam material such as EVA polyethylene blend, rubber, a viso-elastic polymer such as SORBOTHANE and other shock-absorbing materials.

11. A dance shoe comprising:

a shoe upper including a toe region, a heel region, and an arch region extending between said toe region and said heel region;

a split sole attached to a bottom of said shoe upper, said split sole including a front sole beneath said toe region of said shoe upper and a rear sole beneath said heel region of said shoe upper, said front and rear soles being spaced from one another for defining a gap between said front and rear soles that extends along the bottom of said shoe upper, said gap being in substantial alignment with said arch region of said shoe upper;

an elastic material attached to the bottom of said shoe upper and covering the gap between said front and rear soles, wherein said elastic material covers an underside of said dance shoe;

at least one support band attached to said shoe upper and being connected with said elastic material for supporting said elastic material in said arch region of said shoe upper.

12. The dance shoe as claimed in claim 11, further comprising a lace coupled with said at least one support band for selectively exerting an upward force on said at least one support band, wherein said at least one support band transfers the upward force to said elastic material for supporting said arch region of said shoe.

13. The dance shoe as claimed in claim 12, wherein said at least one support band comprises a pair of laterally extending bands having first ends adjacent said toe region of said shoe upper and second ends adjacent said heel region of said shoe upper.

14. The dance shoe as claimed in claim 13, wherein said laterally extending bands cross said arch region of said shoe upper.

15. The dance shoe as claimed in claim 13, further comprising supplemental support bands that are attached to said laterally extending support bands.

16. The dance shoe as claimed in claim 15, further comprising one or more loops attached to said supplemental support bands, said loops being adapted to receive a lace.

17. The dance shoe as claimed in claim 11, wherein a first one of said supplemental support bands is attached to one of said laterally extending support bands and a second one of said supplemental support bands is movable relative to the one of said laterally extending support band.

* * * * *